US011332689B2

(12) United States Patent
Adachi et al.

(10) Patent No.: US 11,332,689 B2
(45) Date of Patent: May 17, 2022

(54) PHOSPHORYLATED DISPERSANTS IN FLUIDS FOR ELECTRIC VEHICLES

(71) Applicant: Afton Chemical Corporation, Richmond, VA (US)

(72) Inventors: Tsuneo Adachi, Tsukuba (JP); Lesley Schmid, Richmond, VA (US); Hideaki Mitsui, Atsugi (JP); Christopher Cleveland, Richmond, VA (US); Atanu Adhvaryu, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 16/988,155

(22) Filed: Aug. 7, 2020

(65) Prior Publication Data

US 2022/0041951 A1 Feb. 10, 2022

(51) Int. Cl.

| | |
|---|---|
| ***C10M 153/02*** | (2006.01) |
| ***C10M 169/04*** | (2006.01) |
| ***C10N 30/02*** | (2006.01) |
| ***C10N 40/04*** | (2006.01) |
| ***C10N 30/04*** | (2006.01) |
| ***C10N 30/00*** | (2006.01) |
| ***C10N 30/12*** | (2006.01) |
| ***C10N 20/02*** | (2006.01) |

(52) U.S. Cl.

CPC ..... *C10M 153/02* (2013.01); *C10M 169/041* (2013.01); *C10M 2203/003* (2013.01); *C10M 2225/04* (2013.01); *C10N 2020/02* (2013.01); *C10N 2030/02* (2013.01); *C10N 2030/04* (2013.01); *C10N 2030/12* (2013.01); *C10N 2030/42* (2020.05); *C10N 2040/04* (2013.01)

(58) Field of Classification Search

CPC ..... C10M 153/02; C10M 169/041; C10M 2203/003; C10M 2225/04; C10N 2020/02; C10N 2030/02; C10N 2030/04; C10N 2030/12; C10N 2030/42; C10N 2040/04

See application file for complete search history.

(56) References Cited

U.S. PATENT DOCUMENTS

| | | | | |
|---|---|---|---|---|
| 5,505,868 A * | 4/1996 | Ryan | C10L 1/221 508/188 |
| 8,400,030 B1 * | 3/2013 | Tang | B60H 1/00271 310/54 |
| 2018/0100117 A1 * | 4/2018 | Flores-Torres | C10M 167/00 |

* cited by examiner

*Primary Examiner* — James C Goloboy

(74) *Attorney, Agent, or Firm* — Honigman LLP

(57) ABSTRACT

The present disclosure relates to a lubricating fluid for an electric motor system and a method of lubricating gears and cooling a motor in an electric motor system. In particular, the disclosed technology relates to a lubricating fluid, for use in electric motor vehicle, comprising an oil of lubricating viscosity and at least one phosphorylated dispersant exhibiting increased resistivity after aging.

18 Claims, No Drawings

PHOSPHORYLATED DISPERSANTS IN FLUIDS FOR ELECTRIC VEHICLES

FIELD

The present disclosure relates to a lubricating fluid for an electric motor system and a method of lubricating gears and cooling a motor in an electric motor system. In particular, the disclosed technology relates to a lubricating fluid, for use in electric motor vehicle, comprising an oil of lubricating viscosity, at least one phosphorylated dispersant having between 2.0 wt % and 3.5 wt % of phosphorus. The lubricating fluid has a resistivity after aging of at least 50 MΩ·m, as measured by a modified version of ASTM D2624-15 at 30° C.

BACKGROUND

A major challenge in developing electric vehicle powertrain lubricants is achieving wear performance, inhibiting copper corrosion, and ensuring lubricant compatibility with electrified components in the powertrain over the lifetime of the lubricant. For example, gears within the electric vehicle powertrain require good wear protection. Further, copper present in the electrified components of an electric motor require protection at high temperatures. Additionally, the lubricant electrical resistivity needs to remain relatively high over the lifetime of the lubricant to inhibit electrostatic buildup and discharge in the electrified components.

Despite advances in lubricant technology for electric vehicle powertrains, there is a need for an electric vehicle powertrain lubricant composition having desired wear performance, copper corrosion compatibility, and lubricant electrical resistivity.

SUMMARY AND TERMS

In one aspect or embodiment, a lubricating composition for use in an electric vehicle or a hybrid electric vehicle is described herein. In one embodiment, the lubricating composition includes at least 95 weight percent of a lubricating base oil composition, the lubricating base oil composition including base oil selected from API Group III base oils or blends of Group III base oils with Group II, Group V base oils or mixtures thereof; a phosphorylated succinimide dispersant containing 2 wt % to 3.5 wt % phosphorus, the phosphorylated succinimide dispersant providing 650 ppm or less phosphorus to the lubricating composition; the lubricating composition having 700 ppm or less total phosphorus and the phosphorylated succinimide dispersant provides at least 70% of the total phosphorus; and wherein the lubricating composition has a kinematic viscosity from 3 cSt to 6.5 cSt at 100° C. and has a resistivity of at least 50 M Ω·m, as measured according to ASTM D2624-15 using the lubricating composition at 1.5 volts and at 30° C., after the fluid has been aged according to JIS K2514-1 at 150° C.; wherein if the lubricating base oil composition comprises API Group V base oil, the API Group V base oil is present in an amount up to 15 wt % based on the total lubricating composition; wherein if the lubricating base oil composition comprises API Group II base oil, the API Group II is present in an amount up to 80 wt % base on the total lubricating composition.

In other embodiments, the lubricating composition may further include wherein the phosphorylated succinimide dispersant is a first dispersant and wherein the composition further comprises a second dispersant containing 0.2 wt % to 0.4 wt % phosphorus, the second dispersant providing 50 ppm or less phosphorus to the lubricating composition; and/or wherein the phosphorylated succinimide dispersant contains 2.5 wt % to 3.0 wt % phosphorus.

In yet other embodiments, any lubricating composition herein may include the phosphorylated succinimide dispersant to provide 115 ppm to 600 ppm phosphorus to the lubricating composition' and/or the phosphorylated succinimide dispersant provides 115 ppm to 250 ppm phosphorus to the lubricating composition; and/or the first dispersant delivers 115 ppm to 250 ppm of phosphorus to the lubricating composition and the second dispersant delivers 40 ppm or less of phosphorus to the lubricating composition; and/or wherein the phosphorylated succinimide dispersant provides 250 ppm or less phosphorus to the lubricating composition and wherein the lubricating composition has 300 ppm or less total phosphorus.

In yet other embodiments, any lubricating composition herein may have a resistivity of at least 115 M Ω·m after the fluid has been aged according to JIS K2514-1 at 150° C.

In other embodiments, any lubricating composition herein may have a base oil composition is selected from API Group III base oils or API Group II base oils combined with mixtures of API Group II and Group III base oils.

In another embodiment, any lubricating composition herein may include the phosphorylated succinimide dispersant to provide between 115 ppm and 250 ppm phosphorus to the lubricating composition; and the lubricating composition has between 160 ppm and 300 ppm total phosphorus, a kinematic viscosity from 5.5 cSt to 6.0 cSt at 100° C., and a resistivity of at least 115 M Ω·m after the fluid has been aged according to JIS K2514-1 at 150° C.

In another aspect or embodiment of the present disclosure, a method of improving electrical resistivity of a lubricating composition in an electric or hybrid electric vehicle is provided. In one approach, the method includes providing to an electric or hybrid electric vehicle powertrain a lubricating oil having a composition comprising at least 95 weight percent of a lubricating base oil composition, the lubricating base oil composition comprising base oil selected from API Group III base oils or blends of API Group III base oils with API Group II, API Group V base oils, or mixtures thereof; a phosphorylated succinimide dispersant containing 2 wt % to 3.5 wt % phosphorus, the phosphorylated succinimide dispersant providing 650 ppm or less phosphorus to the lubricating composition; the lubricating composition having 700 ppm or less phosphorus and the phosphorylated succinimide dispersant provides at least 70% of the total phosphorus; and wherein the lubricating oil has a kinematic viscosity from 3 cSt to 6.5 cSt at 100° C. and has a resistivity of at least 50 M Ω·m, as measured according to ASTM D2624-15 using the lubricating composition at 1.5 volts and at 30° C., after the fluid has been aged according to JIS K2514-1 at 150° C.; and wherein if the lubricating base oil composition comprises API Group V base oil, the API Group V base oil is present in an amount up to 15 wt % based on the total lubricating composition; and wherein if the lubricating base oil composition comprises API Group II base oil, the API Group II is present in an amount up to 80 wt % base on the total lubricating composition.

In other embodiments of the methods, the phosphorylated succinimide dispersant is a first dispersant and wherein the composition further comprises a second dispersant containing 0.2 wt % to 0.4 wt % phosphorus, the second dispersant providing 50 ppm or less phosphorus to the lubricating composition; and/or wherein the phosphorylated succinimide dispersant contains 2.5 wt % to 3.0 wt % phosphorus.

In yet other embodiments of any method herein, the phosphorylated succinimide dispersant provides 115 ppm to 600 ppm phosphorus to the lubricating composition; and/or the phosphorylated succinimide dispersant provides 115 ppm to 250 ppm phosphorus to the lubricating composition; and/or the first dispersant delivers 115 ppm to 250 ppm of phosphorus to the lubricating composition and the second dispersant delivers 40 ppm or less phosphorus to the lubricating composition; and/or the phosphorylated succinimide dispersant provides 250 ppm or less phosphorus to the lubricating composition and wherein the lubricating composition has 300 ppm or less total phosphorus.

In yet further embodiments of any method, the lubricating composition has resistivity of at least 115 M Ω·m after the fluid has been aged according to JIS K2514-1 at 150° C.; and/or the base oil composition is selected from API Group III base oils or blends of API Group II and III base oils or mixtures thereof; and/or the phosphorylated succinimide dispersant provides 115 ppm to 250 ppm phosphorus to the lubricating composition and the lubricating composition has 160 ppm to 300 ppm total phosphorus, a kinematic viscosity from 5.5 cSt to 6.0 cSt at 100° C., and a resistivity of at least 115 M Ω·m after the fluid has been aged according to JIS K2514-1 at 150° C.

In yet other embodiments, the present disclosure provides a use, in a hybrid or electric vehicle, of a lubricating composition comprising a phosphorylated succinimide dispersant for improving electrical resistivity durability of a lubricating composition, wherein the lubricating composition is described in any embodiment above and herein. In other embodiments, a use is provided, in a hybrid or electric vehicle, of a lubricating composition comprising a phosphorylated succinimide dispersant as described in any embodiment herein for achieving a resistivity of at least 50 M Ω·m after the fluid has been aged according to JIS K2514-1 at 150° C. In yet further embodiments, a use is described, in a hybrid or electric vehicle, of a lubricating composition comprising a phosphorylated succinimide dispersant as described in any embodiment herein for achieving at least one or more of a resistivity of at least 50 M Ω·m after the fluid has been aged according to JIS K2514-1 at 150° C., for reducing wear scar, and/or for reducing copper corrosivity of the lubricating composition.

Other embodiments of the present disclosure will be apparent to those skilled in the art from consideration of the specification and practice of the invention disclosed herein.

The following definitions of terms are provided in order to clarify the meanings of certain terms as used herein.

The terms "lubricating oil," "lubricant composition," "lubricating composition," "lubricant" and "lubricating and cooling fluid" refer to a finished lubrication product comprising a major amount of a base oil plus a minor amount of an additive composition.

As used herein, the terms "additive package," "additive concentrate," "additive composition," and "transmission fluid additive package" refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties of from about 1 to about 200 carbon atoms.

The term "alkenyl" as employed herein refers to straight, branched, cyclic, and/or substituted unsaturated chain moieties of from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "number average molecular weight" or "Mn" is determined by gel permeation chromatography (GPC) using commercially available polystyrene standards (with a Mn of 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

According to an exemplary embodiment, a lubricating fluid for use in an electric or hybrid electric vehicle is described herein that contains base oil and at least one phosphorylated succinimide dispersant having 2.0 wt % to 3.5 wt % of phosphorus. In one embodiment, the phosphorylated succinimide dispersant having 2.0 wt % to 3.5 wt % of phosphorus delivers less than 650 ppm phosphorus to the lubricating fluid. In other embodiments, the phosphorylated succinimide dispersant has 2.5 wt % to 3.2 wt % phosphorus, in yet other embodiments, 2.8 wt % to 3.2 wt % phosphorus, and in yet further embodiments, about 3 wt % phosphorus. In any embodiment herein, the phosphorylated succinimide dispersant may provide up to 650 ppm phosphorus to the fluid, up to 600 ppm phosphorus to the fluid, up to 500 ppm phosphorus, up to 400 ppm phosphorus, up to 300 ppm phosphorus, or up to 250 ppm phosphorus. In other embodiments, the phosphorylated succinimide dispersant may provide at least 100 ppm phosphorus, at least 120 ppm phosphorus, or at least 150 ppm phosphorus to the fluids herein.

The fluids herein may also contain other sources of phosphorus, but the total phosphorus content of the fluid may be 700 ppm or less, 650 ppm or less, 600 ppm or less, 550 ppm or less, 500 ppm or less, 450 ppm or less, 400 ppm or less, 350 ppm or less, 300 ppm or less, 250 ppm or less, or 200 ppm or less. The fluids may also include 100 ppm or more of total phosphorus. In embodiments with other sources of phosphorus, the phosphorus provided from the phosphorylated succinimide dispersant provides at least about 70% of the total phosphorus, at least about 75%, at least about 80%, at least about 90%, or even at least about 92% of the total phosphorus in the fluid. In other approaches, the phosphorus provided by the phosphorylated succinimide dispersant provides 100% or less of the total phosphorus, 98% or less, 95% or less, or 90% or less of the total phosphorus.

As discussed more below, the fluids herein with the base oils and the at least one phosphorylated succinimide dispersant generally has a kinematic viscosity from 3 cSt to 6.5 cSt at 100° C. and has a resistivity of at least 50 M Ω·m, as measured according to ASTM D2624-15 (as described herein using the lubricating composition at 1.5 volts and at 30° C.) after the fluid has been aged according to JIS K2514-1 at 150° C.

Base Oil: Base oils suitable for use in formulating the lubricating fluids for use in electric motor vehicles according to the disclosure may be selected from any of suitable synthetic or natural oils or mixtures thereof having a suitable lubricating viscosity.

Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types.

Oils derived from coal or shale may also be suitable. Further, oil derived from a Fischer-Tropsch gas-to-liquid process is also suitable. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949. The base oil may have a kinematic viscosity at 100° C. of 2 to 15 cSt, as measured by ASTM D2270-10(2016).

The base oil as used in the invention described herein may be a single base oil or may be a mixture of two or more base oils. The one or more base oil(s) may be selected from any of the base oils in Groups II to V as specified in the American Petroleum Institute (API) Base Oil Interchangeability Guidelines. In some embodiments, the base oil is a Group III base oil or a Group III base oil combined with one or more of a Group II or a Group V base oil. Such base oil groups are shown in Table 1 as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

In one variation, in any of the foregoing embodiments, the base oil may be selected from a Group II to Group V base oil, or a mixture of these base oils. In one embodiment, the base oil includes a Group III base oil or a blend of Group III base oils with Group II and/or Group V base oils. In one embodiment, the lubricating composition includes at least 75 wt % of a Group II and/or Group III base oil. In another embodiment, the lubricating composition includes at least 90 wt % of a Group III base oil. In another embodiment, the lubricating composition includes at least 10 wt % of a Group V base oil.

In yet other embodiments, when the lubricating composition includes a Group V base oil, the Group V base oil is present in an amount in the lubricating composition ranging from at least about 5 wt %, at least about 8 wt %, or at least about 10 wt % and/or up to 20 wt %, up to 15 wt % or up to 12 wt % (the remainder being a Group III base oil). In yet other embodiments, when the lubricating composition includes a Group II base oil, the Group II base oil is present in an amount in the lubricating composition ranging from at least about 50 wt %, at least about 75 wt % or at least about 77 wt % and/or up to 80 wt %, up to 78 wt %, or up to 77 wt % (the remainder being a Group II and/or Group V base oil).

Group V base oils include synthetic and natural ester base fluids. Synthetic esters may comprise esters of dicarboxylic acids with monohydric alcohols. Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, and the 2-ethylhexyl diester of linoleic acid dimer. Other synthetic esters include those made from $C_5$ to $C_{12}$ monocarboxylic acids and polyols and polyol ethers such as neopentyl glycol, trimethylolpropane, pentaerythritol, dipentaerythritol, and tripentaerythritol. Esters can also be monoesters of mono-carboxylic acids and monohydric alcohols.

Natural esters refer to materials derived from a renewable biological resource, organism, or entity, distinct from materials derived from petroleum or equivalent raw materials. Natural esters include fatty acid triglycerides, hydrolyzed or partially hydrolyzed triglycerides, or transesterified triglyceride esters, such as fatty acid methyl ester (or FAME). Suitable triglycerides include, but are not limited to, palm oil, soybean oil, sunflower oil, rapeseed oil, olive oil, linseed oil, and related materials.

The base oil(s) may be combined with an additive composition as disclosed in embodiments herein to provide a lubricating fluid for use in an electric motor vehicle. Accordingly, the base oil may be present in the lubricating fluid in an amount greater than about 90 wt % based on the total weight of the lubricating fluid. In some embodiments, the base oil may be present in the lubricating fluid in an amount greater than about 95 wt % based on the total weight of the lubricating fluid.

Additive Composition

Phosphorylated Succinimide Dispersant: The lubricating fluid described herein contains at least one phosphorylated succinimide dispersant.

Hydrocarbyl-dicarboxylic acid or anhydrides reacted with polyalkylene polyamines are used to make succinimide dispersants. Succinimide dispersants and their preparation are disclosed, for instance in U.S. Pat. Nos. 7,897,696 and 4,234,435, which are incorporated herein by reference. The hydrocarbyl moiety of the hydrocarbyl-dicarboxylic acid or anhydride of may be derived from butene polymers, for example polymers of isobutylene. Suitable polyisobutenes for use herein include those formed from conventional polyisobutylene or highly reactive polyisobutylene having at least 60%, such as 70% to 90% and above, terminal vinylidene content. Suitable polyisobutenes may include those prepared using $BF_3$ catalysts.

The number average molecular weight of the polyisobutylene substituent may vary over a wide range, for example from 500 to 5000, as determined by gel permeation chromatography (GPC) using polystyrene (with a number average molecular weight of 180 to about 18,000) as the calibration reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

The polyisobutylene moiety in a dispersant preferably has a polydispersity index (PDI), as determined by the ratio of weight average molecular weight (Mw) to number average molecular weight (Mn). Polymers having a Mw/Mn of less than 2.2, preferably less than 2.0, are most desirable. Suitable polyisobutylene substituents have a polydispersity of from about 1.5 to 2.1, or from about 1.6 to about 1.8.

The dicarboxylic acid or anhydride of may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic, anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of acid or anhydride to hydrocarbyl moiety is from 1:1 to less than 1.6:1. Another useful molar ratio of dicarboxylic acid or anhydride to hydrocarbyl moiety is 1:1 to 1.7:1, or 1:1 to 1.6:1, or 1:1 to 1.5:1.

Any of numerous polyalkylene polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3:1.

The dispersant described herein is phosphorylated. These dispersants are generally the reaction products of at least one phosphorus compound and at least one ashless succinimide dispersant as described above.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

In embodiments, the phosphorylated dispersant is a reaction product of the succinimide molecule and the phosphorus source. In one example, a polyisobutyl succinimide (PIBSI) or other suitable succinimide is heated to about 100° C. The phosphorus acid or other phosphorus source is then added under slight vacuum (700 mm Hg) and held for 30 minutes to 1 hour (to remove any water). Next, the temperature is slowly raised to approximately 160° C. and then held for about 2 hours. Lastly, the solution is placed under vacuum and held for about another 1-2 hours to form the phosphorylated succinimide dispersant.

In some embodiments, the succinimide dispersant may also be optionally further post-treated with a boron source. Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-B$(OH)_2$ or aryl-B$(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

In some approaches, the dispersant used in the present disclosure comprises a polyisobutenyl moiety having a number average molecular weight in the range of from about 800 to 2500, or from 900 to 1200, or from 975 to 1175 and is present in the lubricating fluid an amount sufficient to deliver greater than 50 ppm nitrogen, or greater than 100 ppm nitrogen, or greater than 250 ppm nitrogen, or between 50 to 300 ppm nitrogen, or between 50 to 120 ppm nitrogen, or between 120 to 300 ppm nitrogen.

The dispersant used in the present invention is present in the lubricating fluid an amount sufficient to deliver greater than 100 ppm phosphorus, or greater than 200 ppm phosphorus, or greater than 550 ppm phosphorus, or between 100 to 700 ppm phosphorus, or between 100 to 300 ppm phosphorus, or between 300 to 700 ppm phosphorus.

In one embodiment, the dispersant in the invention described herein may be obtained from a HR-PIB having a Mn of between 975 to 1175, a Mw of between 1700 to 2100, and in some approaches a PDI of 1.8 or less. Further, the dispersant may have a molar ratio of (A) polyisobutenyl-substituted succinic anhydride to (B) polyamine in the range of 4:3 to 5:2 and a phosphorus content of between 2.5 wt % and 3.25 wt %.

As shown in the examples herein, when a succinimide dispersant having 2.0 wt % to 3.5 wt % (in other embodiments, 2.5 to 3.2 wt %, 2.8 to 3.2 wt %, or about 3 wt %) of phosphorus is present in the lubricating fluid in an amount to deliver between 100 to 650 ppm phosphorus (or other ranges as disclosed herein), the resulting composition has increased electric resistivity and suitable wear protection and copper compatibility, even after aging.

Other Additives: The lubricating fluid described herein may also include one or more of at least one component selected from the group, comprising, an antioxidant, a friction modifier, a detergent, a corrosion inhibitor, a copper corrosion inhibitor, an antifoam agent, a seal-swell agent, an extreme pressure agent, an anti-wear agent, a viscosity modifier, an additional dispersant, and combinations thereof. Other performance additives may also include, in addition to those specified above, one or more of metal deactivators, demulsifiers, pour point depressants, and mixtures thereof.

Antioxidants: In some embodiments, the lubricating fluid contains one more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol). N,N'-di-sec-butyl-phenylenediamine, 4-isopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

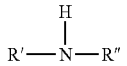

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenyl amine, p-oriented styrenated diphenylamine, mixed butyloctyldi-phenylamine, and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating fluid described herein may be present in an amount to deliver up to 200 ppm nitrogen, or up to 100 ppm nitrogen, or up to 150 ppm nitrogen, or between 100-150 ppm nitrogen.

Friction Modifiers: Suitable additional friction modifiers may comprise metal containing and metal-free friction modifiers and may include, but are not limited to, imidazolines, aliphatic fatty acid amides, aliphatic amines, succinimides, alkoxylated aliphatic amines, ether amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

If the additional friction modifiers contain nitrogen, such additional friction modifiers may be present in the lubricating fluid in an amount to deliver up to 200 ppm nitrogen, or up to 150 ppm nitrogen, or between 100-150 ppm nitrogen.

Detergents: Metal detergents that may be included in the lubricating fluid described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the lubricating fluid in an amount sufficient to improve the anti-rust performance of the fluid. The metal-containing detergent may be present in the fluid in an amount sufficient to provide up to 300 ppm alkali and/or alkaline earth metal based on a total weight of the lubricating fluid. In one example, the metal-containing detergent may be present in an amount sufficient to provide from 100 to 300 ppm alkali and/or alkaline earth metal. In another embodiment, the metal-containing detergent may be present in an amount sufficient to provide from 220 to 250 ppm alkali and/or alkaline earth metal.

Corrosion Inhibitors: Rust or corrosion inhibitors may also be included in the lubricating compositions described herein. Suitable copper corrosion inhibitors include ether amines, polyethoxylated compounds such as ethoxylated amines and ethoxylated alcohols, imidazolines, monoalkyl and dialkyl thiadiazole, and the like. Additional compounds include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Thiazoles, triazoles and thiadiazoles may also be used in the lubricants. Examples include benzotriazole; tolyltriazole; octyltriazole; decyltriazole; dodecyltriazole; 2-mercaptobenzotriiazole; 2,5-dimercapto-1,3,4-thiadiazole; 2-mercapto-5-hydrocarbylthio-1,3,4-thiadiazoles; and 2-mercapto-5-hydrocarbylthio-1,3,4-thiadiazoles. The preferred compounds are the 1,3,4-thiadiazoles, especially the 2-hydrocarbyldithio-5-mercapto-1,3,4-dithiadiazoles, a number of which are available as articles of commerce.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols.

Mixtures of such rust or corrosion inhibitors may be used. The total amount of corrosion inhibitor, when present in the lubricating composition described herein may range up to 2.0 wt % or from 0.01 to 1.0 wt % based on the total weight of the lubricating composition.

Extreme Pressure Agents: The lubricating fluid described herein may optionally include one or more extreme pressure (EP) agents. EP agents that are soluble in the oil include sulfur- and chlorosulfur-containing EP agents, chlorinated hydrocarbon EP agents and phosphorus EP agents. Examples of such EP agents include chlorinated waxes; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Anti-Wear Agents: The lubricating oil compositions herein also may optionally contain one or more anti-wear agents. Examples of suitable antiwear agents include, but are not limited to, a metal thiophosphate; a metal dialkyldithiophosphate; a phosphoric acid ester or salt thereof a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl) disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, in other approaches, about 0.01 wt % to about 10 wt %, in yet other approaches, about 0.05 wt % to about 5 wt %, or, in further approaches, about 0.1 wt % to about 3 wt % of the lubricating oil composition.

Viscosity Modifiers: The lubricating fluid may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The lubricating fluid described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to 1.0 wt %, or up to 0.5 wt %, or up to 0.3 wt % based on the total weight of the lubricating fluid.

Additional Dispersant: The lubricating fluid may include one more additional dispersants than the phosphorylated succinimide dispersant described above. The additional dispersants are ashless dispersants having a polar group attached to a relatively high molecular weight hydrocarbon chain. Examples of such dispersants are N-substituted long chain alkenyl succinimides, succinic ester dispersants, succinic ester-amide dispersants, Mannich base dispersants, polymeric polyamine dispersants, phosphorylated forms thereof, and boronated forms thereof. The dispersants may be capped with acidic molecules capable of reacting with secondary amino groups.

The N-substituted long chain alkenyl succinimide may include polyisobutylene (PIB) substituents with a number average molecular weight of the polyisobutylene substituent in a range of about 500 to 5000 as determined by the GPC method described above. The PIB substituent used in the dispersant also has a viscosity at 100° C. of about 2100 to about 2700 cSt as determined by ASTM D445.

The polyisobutylene moiety in the dispersant preferably has a narrow molecular weight distribution (MWD), also referred to as polydispersity, as determined by the ratio of weight average molecular weight (Mw) to number average molecular weight (Mn). Polymers having a Mw/Mn of less than 2.2, preferably less than 2.0, are most desirable. Suitable polyisobutylene substituents have a polydispersity of from about 1.5 to 2.1, or from about 1.6 to about 1.8.

The dicarboxylic acid or anhydride of may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of acid or anhydride to hydrocarbyl moiety is from 1:1 to less than 1.6:1. Another useful molar ratio of dicarboxylic acid or anhydride to hydrocarbyl moiety is 1.3:1 to 1.7:1, or 1.3:1 to 1.6:1, or 1.3:1 to 1.5:1.

Any of numerous polyalkylene polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3.0:1.

The Mannich base dispersants may be a reaction product of an alkyl phenol, typically having a long chain alkyl substituent on the ring, with one or more aliphatic aldehydes containing from about 1 to about 7 carbon atoms (especially formaldehyde and derivatives thereof), and polyamines (especially polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

The additional dispersant described herein may be borated and/or phosphorylated. This type of dispersant is generally the reaction products of i) at least one phosphorus compound and/or a boron compound and ii) at least one ashless dispersant.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants described herein may include mixtures of one or more boronated and phosphorylated dispersants set forth above combined with non-boronated and non-phosphorylated dispersants.

If used, treat rates of the dispersants described above are provided in about 1 to about 15 weight percent and, in other approaches, about 2 to about 13 weight percent, and in yet other approaches, about 4 to about 10 weight percent in the lubricant.

Antifoam Agents: Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating fluid may be up 0.1 wt, or up to 0.08 wt %, or below 0.07 wt % based on the total weight of the lubricating fluid.

Seal-Swell Agents: The fluids of the present disclosure may further include seal swell agents. Seal swell agents such as esters, adipates, sebacates, azealates, phthalates, sulfones, alcohols, alkyibenzenes, substituted sulfolanes, aromatics, or mineral oils cause swelling of elastomeric materials used as seals in engines and automatic transmissions.

Alcohol-type seal swell agents are generally low volatility linear alkyl alcohols, such as decyl alcohol, tridecyl alcohol and tetradecyl alcohol. Alkylbenzenes useful as seal swell agents include dodecylbenzenes, tetradecylbenzenes, dinonyl-benzenes, di(2-ethylhexyl)benzene, and the like. Substituted sulfolanes (e.g. those described in U.S. Pat. No. 4,029,588, incorporated herein by reference) are likewise useful as seal swell agents in compositions according to the present invention. Mineral oils useful as seal swell agents in the present disclosure include low viscosity mineral oils with high naphthenic or aromatic content.

In general terms, a lubricating fluid described herein may include additive components in the ranges listed in Table 2.

TABLE 2

| Component | Wt % (Suitable Embodiments) | Wt % (Preferred Embodiments) |
|---|---|---|
| Dispersant of Present Invention | 0.1-5 | 0.4-2 |
| Additional Dispersants | 0-5 | 0.5-2 |
| Friction Modifier | 0-3 | 0.005-1 |
| Detergents | 0-5 | 0.005-0.5 |
| Antioxidants | 0-5 | 0.005-1 |
| Corrosion and Rust inhibitors | 0.1-5 | 0.3-1 |
| Antiwear agents | 0-5 | 0-3 |
| Seal Swell agents | 0-3 | 0-1 |
| Extreme Pressure agents | 0-2 | 0-1 |
| Antifoaming agents | 0-1 | 0.005-0.8 |
| Viscosity index improvers | 0-5 | 0.1-0.5 |
| Base oil(s) | Balance | Balance |
| Total | 100 | 100 |

The percentages of each component above represent the weight percent of each component, based upon the total weight of the lubricating fluid containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

EXAMPLES

The following non-limiting examples illustrate the features and advantages of one or more embodiments of the disclosure. Unless noted otherwise or apparent from the context of discussion, all percentages, ratios, and parts noted in the examples and throughout this disclosure are by weight.

It is beneficial for electric motor transmission fluids to exhibit high volume resistivity, and thus act somewhat as an insulator. A higher resistivity score indicates the fluid's ability to act as an insulator. To demonstrate how the phosphorylated succinimide dispersant having between 2.0 wt % and 3.5 wt % phosphorus increases the resistivity of the fluid, exemplary finished fluids were formulated, aged, and evaluated.

To age the fluids, the fluids were subjected to accelerated oxidation using the Indiana Stirring Oxidation Test at 150° C. (modified version of JIS K2514-1). The resistivity of the oxidized fluids was measured after the fluids were cooled to 30° C. The resistivity of the fluid was measured according to a modified version (testing of a lubricant, rather than of a fuel) of ASTM D2624-15 at 30° C. using an Epsilon+ electrical conductivity meter (Flucon Fluid Control GmbH) or equivalent meter at 1.5 volts to obtain at least one reading for each fluid being evaluated.

The fluids were also evaluated for wear performance and copper corrosion compatibility. The wear performance of the fluids was measured according to ASTM D4172. The copper corrosion compatibility was measured using an extended copper corrosion test—a modified version of ASTM D130-18—in which copper strips are immersed in the lubricant for a set duration and given temperature. The oil is evaluated for levels of copper. Higher levels of copper in the oil indicate the corrosiveness of the lubricant to copper. In the examples that follow, the temperature was held at 150° C. for 120 hours.

The formulations tested in Table 3 below all contained the same base additive package containing friction modifiers, corrosion inhibitor, detergent, antioxidant, a borated and phosphorylated dispersant and a copper corrosion inhibitor. The formulations also contained a phosphorus source. The inventive formulations contain the phosphorylated succinimide dispersant described herein while the comparative formulations contained other types of phosphorus-containing compounds. Details of these components are described below. The formulations were tested in a broad range of base oils at kinematic viscosities at 100° C. of between 4.10 and 4.33 cSt.

Phosphorus Source A: phosphorylated succinimide dispersant made from an HR-polyisobutylene having a Mn between 975-1175, maleic anhydride, a mixture of polyalkylene polyamines having an average of 6.5 nitrogen atoms per molecule, and phosphorous acid. The dispersant was a reaction product of the succinimide and phosphorus. This dispersant has approximately 3.0 wt % phosphorus and approximately 1.4 wt % nitrogen.

Phosphorus Source B: phosphorylated and borated succinimide dispersant made from a conventional polyisobutylene having a Mn between 900 and 980, maleic anhydride, a mixture of polyalkylene polyamines having an average of 6.5 nitrogen atoms per molecule, phosphorous acid, and boric acid. This dispersant has approximately 0.76 wt % phosphorus, approximately 0.35 wt % boron, and approximately 1.75% nitrogen.

Phosphorus Source C: reaction product of sulfur and dibutyl hydrogen phosphonate which is salted with an amine; this phosphorus source has approximately 6 wt % phosphorus, approximately 6.3 wt % sulfur, and approximately 3.1 wt % nitrogen.

Phosphorus Source D: alkyl thiophosphate ester having approximately 9 wt % phosphorus and approximately 19 wt % sulfur.

The inventive formulations containing Phosphorus Source A, the highly phosphorylated succinimide dispersant, achieved surprisingly improved lubricant resistivity. Moreover, the inventive formulations containing Phosphorus Source A also achieved suitable copper corrosion compatibility and wear performance.

TABLE 3

| Base Oil | Inv. 1 Group II/III | Comp. 1 Group II | Comp. 2 Group II/III | Comp. 3 Group II/III | Inv. 2 Group III | Comp. 4 Group III |
|---|---|---|---|---|---|---|
| kV100 cSt | 3.4 | 3.3 | 3.4 | 3.4 | 6.0 | 6.2 |
| Phosphorus Source | A | B | C | D | A | B |
| Phosphorus Source Treat Rate, wt % | 0.4 | 1.31 | 0.16 | 0.11 | 2.0 | 6.5 |
| Phosphorus delivered to finished fluid from the Phosphorus Source, ppm P (calculated) | 120 | 100 | 96 | 99 | 600 | 494 |
| Total Phosphorus in finished fluid, ppm P (measured by ICP) | 167 | 140 | 141 | 135 | 650 | 526 |
| Resistivity after ISOT at 30° C., MΩ · m | 70 | 46 | 59 | 64 | 66 | 32 |
| D130 (120 hrs) Cu ppm in oil | 31 | 68 | 131 | 24 | 2 | 98 |
| Four Ball Average Scar at 80° C., mm | 0.675 | 0.573 | 0.893 | 0.902 | 0.680 | 0.628 |
| Group II | 77.4% | 95.8% | 77.6% | 77.6% | — | — |
| Group III | 19.3% | — | 19.4% | 19.4% | 95.1 | 90.6 |

In Table 3, Inv. 1, Comp. 1, Comp. 2, and Comp. 3 were formulated to have approximately the same kinematic viscosity. Each formulation contained a different phosphorous source but had similar phosphorus treat rates. Inv. 1 containing Phosphorus Source A, had a higher resistivity after aging compared to corresponding Comp. 1, 2, and 3. Moreover, Inv. 1 maintained suitable wear performance and copper corrosion compatibility. While Comp. 1, containing Phosphorous Source B, had a slightly lower wear scar than Inv. 1, it had more copper in oil, and thus, a poorer ability to inhibit copper corrosion, and a lower electrical resistivity after aging. While Comp. 3, containing Phosphorous Source D, had slightly better copper corrosion performance than Inv. 1, it had a larger wear scar and lower electrical resistivity after aging. Comp. 2 performed worse than Inv. 1 in wear, copper corrosion compatibility, and electrical resistivity.

Inv. 2 and Comp. 4 are formulated to have approximately the same kinematic viscosity. Each formulation contained a different phosphorous source but has similar phosphorus treat rates. Inv. 2 containing Phosphorus Source A, had a higher resistivity and better copper corrosion compatibility and wear performance, compared to Comp. 4.

Inv. 3-Inv. 5 and Comp. 5 and 6 are additional examples of inventive and comparative fluids formulated at various kinematic viscosities and phosphorus treat rates as shown in Table 4 below. While comparative samples 5 and 6 used phosphorus source A and may have had lower wear scar and copper corrosion, they both exhibited poor resistivity believed, in part, due to base oil contributions.

TABLE 4

| Base Oil | Inv. 3 Group III | Inv. 4 Group III | Inv. 5 Group III/V | Comp. 5 Group III/V | Comp. 6 Group II |
|---|---|---|---|---|---|
| kV100 cSt | 5.5 | 5.9 | 6.1 | 3.4 | 3.3 |
| Phosphorus Source | A | A | A | A | A |
| Phosphorus Source Treat Rate wt % | 0.8 | 0.4 | 2.0 | 0.4 | 2.0 |
| Phosphorus delivered to finished fluid from the Phosphorus | 240 | 120 | 600 | 120 | 600 |

TABLE 4-continued

| Base Oil | Inv. 3 Group III | Inv. 4 Group III | Inv. 5 Group III/V | Comp. 5 Group III/V | Comp. 6 Group II |
|---|---|---|---|---|---|
| Source, ppm P (calculated) | | | | | |
| Total Phosphorus in finished fluid, ppm P (measured by ICP) | 288 | 167 | 633 | 165 | 651 |
| Resistivity after ISOT at 30C, MΩ · m | 117 | 148 | 54 | 40 | 28 |
| D130 (120 hrs) Cu ppm in oil | 16 | 25 | 3 | 14 | 5 |
| Four Ball Average Scar at 80C, mm | 0.596 | 0.65 | 0.423 | 0.457 | 0.432 |
| Group II | _— | — | | | 95.1% |
| Group III | 96.3% | 96.7% | 83.7% | 48.4% | — |
| Group IV | — | — | 11.4% | 48.4% | — |

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A lubricating composition for use in an electric vehicle comprising:

at least 95 weight percent of a lubricating base oil composition, the lubricating base oil composition including base oil selected from API Group III base oils or blends of Group III base oils with Group II, Group V base oils or mixtures thereof;

a phosphorylated succinimide dispersant containing 2 wt % to 3.5 wt % phosphorus, the phosphorylated succinimide dispersant providing 650 ppm or less phosphorus to the lubricating composition;

the lubricating composition having 700 ppm or less total phosphorus and the phosphorylated succinimide dispersant provides at least 70% of the total phosphorus; and wherein the lubricating composition has a kinematic viscosity from 3 cSt to 6.5 cSt at 100° C. and has a resistivity of at least 50 M Ω·m, as measured according to ASTM D2624-15 using the lubricating composition at 1.5 volts and at 30° C., after the fluid has been aged according to JIS K2514-1 at 150° C.;

wherein if the lubricating base oil composition comprises API Group V base oil, the API Group V base oil is present in an amount up to 15 wt % based on the total lubricating composition;

wherein if the lubricating base oil composition comprises API Group II base oil, the API Group II is present in an amount up to 80 wt % based on the total lubricating composition;

wherein the phosphorylated succinimide dispersant is a first dispersant and wherein the composition further comprises a second dispersant containing 0.2 wt % to 0.4 wt % phosphorus, the second dispersant providing 50 ppm or less phosphorus to the lubricating composition.

2. The lubricating composition of claim 1, wherein the phosphorylated succinimide dispersant contains 2.5 wt % to 3.0 wt % phosphorus.

3. The lubricating composition of claim 2, wherein the phosphorylated succinimide dispersant provides 115 ppm to 600 ppm phosphorus to the lubricating composition.

4. The lubricating composition of claim 3, wherein the phosphorylated succinimide dispersant provides 115 ppm to 250 ppm phosphorus to the lubricating composition.

5. The lubricating composition of claim 1, wherein the first dispersant delivers 115 ppm to 250 ppm of phosphorus to the lubricating composition and the second dispersant delivers 40 ppm or less of phosphorus to the lubricating composition.

6. The lubricating composition of claim 1, wherein the phosphorylated succinimide dispersant provides 250 ppm or less phosphorus to the lubricating composition and wherein the lubricating composition has 300 ppm or less total phosphorus.

7. The lubricating composition of claim 1, wherein the lubricating composition has resistivity of at least 115 M Ω·m after the fluid has been aged according to JIS K2514-1 at 150° C.

8. The lubricating composition of claim 1, wherein the base oil composition is selected from API Group III base oils or mixtures of API Group II and Group III base oils.

9. The lubricating composition of claim 8 wherein, the phosphorylated succinimide dispersant provides between 115 ppm and 250 ppm phosphorus to the lubricating composition; and the lubricating composition has between 160 ppm and 300 ppm total phosphorus, a kinematic viscosity from 5.5 cSt to 6.0 cSt at 100° C., and a resistivity of at least 115 M Ω·m after the fluid has been aged according to JIS K2514-1 at 150° C.

10. A method of improving electrical resistivity of a lubricating composition in an electric vehicle comprising providing to an electric vehicle powertrain a lubricating oil having a composition comprising:

at least 95 weight percent of a lubricating base oil composition, the lubricating base oil composition comprising base oil selected from API Group III base oils or blends of API Group III base oils with API Group II, API Group V base oils, or mixtures thereof;

a phosphorylated succinimide dispersant containing 2 wt % to 3.5 wt % phosphorus, the phosphorylated succinimide dispersant providing 650 ppm or less phosphorus to the lubricating composition;

the lubricating composition having 700 ppm or less phosphorus and the phosphorylated succinimide dispersant provides at least 70% of the total phosphorus; and wherein the lubricating oil has a kinematic viscosity from 3 cSt to 6.5 cSt at 100° C. and has a resistivity of at least 50 M Ω·m, as measured according to ASTM D2624-15 using the lubricating composition at 1.5 volts and at 30° C., after the fluid has been aged according to JIS K2514-1 at 150° C.; and wherein if the lubricating base oil composition comprises API Group V base oil, the API Group V base oil is present in an amount up to 15 wt % based on the total lubricating composition;

wherein if the lubricating base oil composition comprises API Group II base oil, the API Group II is present in an amount up to 80 wt % based on the total lubricating composition;

wherein the phosphorylated succinimide dispersant is a first dispersant and wherein the composition further comprises a second dispersant containing 0.2 wt % to 0.4 wt % phosphorus, the second dispersant providing 50 ppm or less phosphorus to the lubricating composition.

11. The method of claim 10, wherein the phosphorylated succinimide dispersant contains 2.5 wt % to 3.0 wt % phosphorus.

12. The method of claim 11, wherein the phosphorylated succinimide dispersant provides 115 ppm to 600 ppm phosphorus to the lubricating composition.

13. The method of claim 12, wherein the phosphorylated succinimide dispersant provides 115 ppm to 250 ppm phosphorus to the lubricating composition.

14. The method of claim 10, wherein the first dispersant delivers 115 ppm to 250 ppm of phosphorus to the lubricating composition and the second dispersant delivers 40 ppm or less phosphorus to the lubricating composition.

15. The method of claim 10, wherein the phosphorylated succinimide dispersant provides 250 ppm or less phosphorus to the lubricating composition and wherein the lubricating composition has 300 ppm or less total phosphorus.

16. The method of claim 10, wherein the lubricating composition has resistivity of at least 115 M Ω·m after the fluid has been aged according to JIS K2514-1 at 150° C.

17. The method of claim 10, wherein the base oil composition is selected from API Group III base oils or blends of API Group II and III base oils or mixtures thereof.

18. The method of claim 17 wherein, the phosphorylated succinimide dispersant provides 115 ppm to 250 ppm phosphorus to the lubricating composition and the lubricating composition has 160 ppm to 300 ppm total phosphorus, a kinematic viscosity from 5.5 cSt to 6.0 cSt at 100° C., and a resistivity of at least 115 M Ω·m after the fluid has been aged according to JIS K2514-1 at 150° C.

* * * * *